United States Patent [19]

Vladislavic

[11] Patent Number: 5,050,358

[45] Date of Patent: Sep. 24, 1991

[54] STRUCTURAL MEMBERS AND BUILDING FRAMES

[76] Inventor: Neven I. Vladislavic, San Juan 4705, San Miguel, Santiago, Chile

[21] Appl. No.: 561,693

[22] Filed: Aug. 1, 1990

[51] Int. Cl.[5] ..... E04B 5/36

[52] U.S. Cl. ..... 52/334; 52/250; 52/252; 52/263; 52/335; 52/648; 52/720; 52/721; 52/724

[58] Field of Search ..... 52/250, 251, 252, 236.8, 52/236.9, 648, 335, 336, 433, 253, 259, 334, 724, 720, 721

[56] References Cited

U.S. PATENT DOCUMENTS

| | | | |
|---|---|---|---|
| 928,935 | 7/1909 | Brooks | 52/724 |
| 1,135,721 | 4/1915 | Robinson | 52/724 X |
| 1,250,588 | 12/1917 | Kahn | 52/336 |
| 2,006,070 | 6/1935 | Stasio | 52/724 |
| 3,147,571 | 9/1964 | Welch | 52/724 |
| 3,812,636 | 5/1974 | Albrecht | 52/334 |
| 4,125,973 | 11/1978 | Lendrihas | 52/724 |
| 4,129,917 | 12/1978 | Sivachenko | 52/335 |
| 4,144,369 | 3/1979 | Wass | 52/334 |
| 4,333,285 | 6/1982 | Koizumi | 52/252 |
| 4,566,240 | 1/1986 | Schilger | 52/334 |
| 4,685,264 | 8/1987 | Landis | 52/252 |
| 4,962,622 | 10/1990 | Albrecht | 52/221 |

*Primary Examiner*—John E. Murtagh

*Attorney, Agent, or Firm*—D. Peter Hochberg; Mark Kusner; Louis J. Weisz

[57] ABSTRACT

Structural members for building structures comprise indented, truncated, V-shaped profiles which include flanges extending horizontally from the open tops thereof. Structural beam members comprise open-ended, elongated members, while structural column members are fabricated by joining counterpart surfaces of two of such profiles together at right angles. The structural members are nested together for transportation to building sites, where they are bolted together and floors formed by fastening corrugated panels to the beam flanges. Concrete is thereafter poured into the open profiles, and onto the deck panels to provide a floored framework for a building structure.

5 Claims, 12 Drawing Sheets

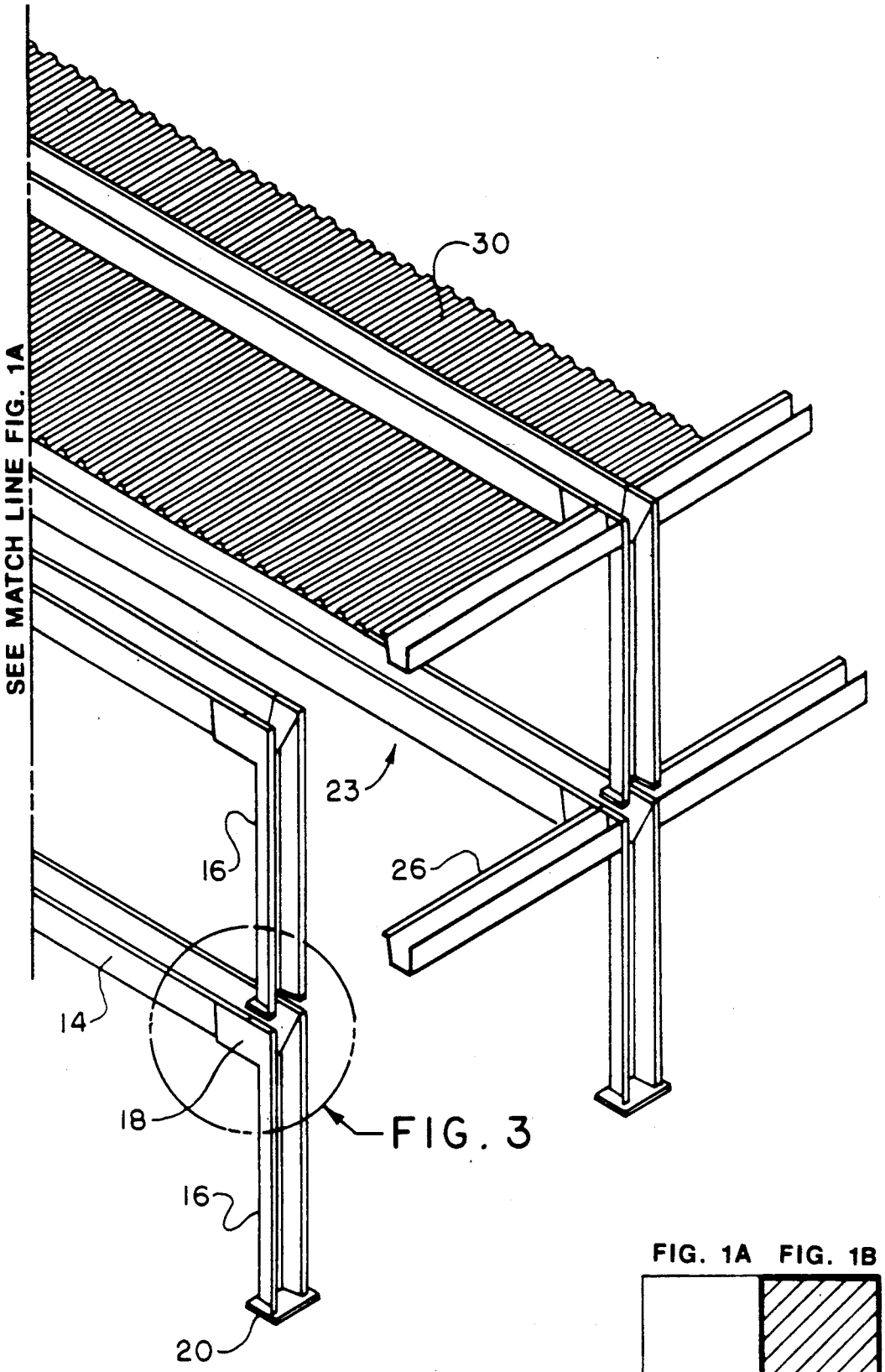
FIG. 1B
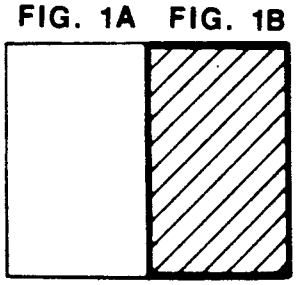

STRUCTURAL MEMBERS AND BUILDING FRAMES

TECHNICAL FIELD

This invention relates to buildings employing skeletal framing, and to structural members used in fabricating the same. More particularly, this invention relates to buildings whose frames are erected from hollow steel profiles that form both beams and columns that are connected together to form a framework, and that may then be filled with concrete to provide composite building structural members. Specifically, this invention relates to indented, elongated steel structural members having truncated, V-shaped transverse cross-sections that are bolted together to provide unitary structural assemblies, and that may thereafter be filled with concrete to form reinforced concrete building structures.

BACKGROUND OF THE INVENTION

Structural members comprising interconnected steel beams and girders are typically used in the construction of modern buildings not only in many single story structures, but particularly in multi-story buildings, since their use is often required to provide the strength necessary to prevent collapse of the structure. Buildings so constructed are not only sturdy, but have a functional life expectancy that in most cases far exceeds the economics of their continued existence.

While the characteristics described have caused such structural members to be widely used for the erection of buildings, they are not without certain inherent disadvantages. Steel columns, beams and girders, for example, are quite bulky and considerable space is, therefore, required to accommodate them. Such structural members are also extremely heavy, and for both reasons they require extensive and frequently involved transportation arrangements to move them from their manufacturing site or storage location to their place of erection. In addition, the erection of traditional structural members typically requires heavy-duty cranes and large scale equipment in order to lift the members into place at the building site. The process of erection also necessitates the services of experienced labor, and involves welding and other relatively high-skill techniques.

A further significant disadvantage of construction utilizing standardized steel structural members lies in the fact that their manufacture can only be accomplished in large, capital-intensive rolling mills of the kind associated with steel manufacturing plants.

Furthermore, while some buildings have been fabricated from reinforced concrete and preformed sections, such construction requires extensive forming, and is often uneconomical as a result. In addition, the use of such methods in multi-structure buildings is limited for reasons that include the excessive weight entailed.

As a consequence of the preceding, therefore, construction of multi-story buildings by standard techniques is not only usually expensive, but it is sometimes impractical due to budgetary constraints. Furthermore, in many locations lacking a skilled work force or suitable construction equipment, or which are relatively remote, such construction is difficult from a practical point of view.

Notwithstanding the preceding, there is a widespread and continuing need for multi-story buildings, for example, up to about five stories in height, not only in urban areas in which standard building methods are possible, but in rural areas in which they are difficult, and in developing countries where both the necessary worker skills and sophisticated erection equipment are often either non-existent, or in short supply. Unfortunately, the latter areas are frequently those having the greatest need for schools, hospitals, and other public buildings of both the single and multi-story variety having superior strength and durabilty characteristics, that can be built using unskilled or semi-skilled labor, and that require only basic tools and equipment for their erection.

BRIEF DESCRIPTION OF THE INVENTION

In view of the preceding, therefore, it is a first aspect of this invention to provide building structures that can be fabricated from interlocking steel profiles.

A second aspect of this invention is to provide inexpensive, light-weight, high-strength structural members.

An additional aspect of this invention is to provide relatively light-weight steel profiles that can be "nested" together for transportation to building sites, thereby greatly reducing transportation problems.

Another aspect of this invention is to provide building structural members that can rapidly and easily be erected by relatively unskilled labor without extensive use of heavy-duty, specialized erection equipment.

A further aspect of this invention is to provide steel structural profiles that can be fabricated from relatively simple, roll-forming equipment.

An additional aspect of this invention is to provide open steel structural profiles that also serve as forms for concrete poured therein.

Yet an additional aspect of this invention is to provide a way in which to make strong but light-weight building frames available both in developed and relatively undeveloped areas.

Still another aspect of this invention is to furnish a way in which to make available composite steel and concrete structural members.

The foregoing and yet further aspects of the invention are provided by an elongated, hollow steel structural member useful for fabricating structures therefrom comprising a trough-like profile that includes a closed bottom; an open top; two sides; and wing-like flanges, said sides diverging as they extend upward from said bottom to said top; said flanges extending outward from said top parallel to said bottom, and said bottom having indentations extending into the interior of said profile.

The foregoing and further aspects of the invention are provided by a structural member for a building structure in which counterpart surfaces of two of the profiles of the preceding paragraph are joined to each other at right angles to form structural columns having a vertical section, and a horizontal section.

The foregoing and other aspects of the invention are provided by a column member for a building structure in which the vertical portions of two of the structural columns according to the preceding paragraph are positioned back-to-back with surfaces of their wing-like flanges adjacent to each other and connected together.

The foregoing and yet additional aspects of the invention are provided by a composite structural component comprising an elongated, hollow steel profile that includes: a closed bottom; an open top; two sides; and wing-like flanges, said sides diverging as they extend upward from said bottom to said top, said profile being provided with indentations extending into the interior of said profile, and said flanges extending outward from the top of at least one of said sides, parallel to said bottom, said profile being filled with concrete.

The foregoing and still other aspects of the invention are provided by skeletal framing of a building formed from interlocked structural components comprising vertical column members and horizontal beam members formed from composite structural components according to the preceding paragraph.

The foregoing and yet further aspects of the invention are provided by skeletal framing for a multi-story structure in which the lower ends of the vertical portions of structural column members according to the penultimate paragraph are positioned over the tops of others of said column members, and in axial alignment therewith, each of said upper columns resting on column support means spaced from the tops of the columns beneath by spacer bolts, said spacer bolts comprising: a bolt head; an upper, larger diameter threaded portion with a first nut engaged therewith; a lower, smaller diameter threaded portion with a second nut engaged therewith; and a shoulder between said larger diameter portion and said smaller diameter portion, wherein said support means is secured between said head and said first nut, and the column beneath is secured between said shoulder and said second nut, the distance between said shoulder and said first nut providing said spacing.

BRIEF DESCRIPTION OF THE DRAWINGS

The invention will be better understood when reference is had to the following drawings, in which like-numbers refer to like-parts, and in which:

FIG. 1A and FIG. 1B are isometric partial views of a structural frame for a building fabricated from the structural members of the invention.

DETAILED DESCRIPTION OF THE INVENTION

Figure 1A:
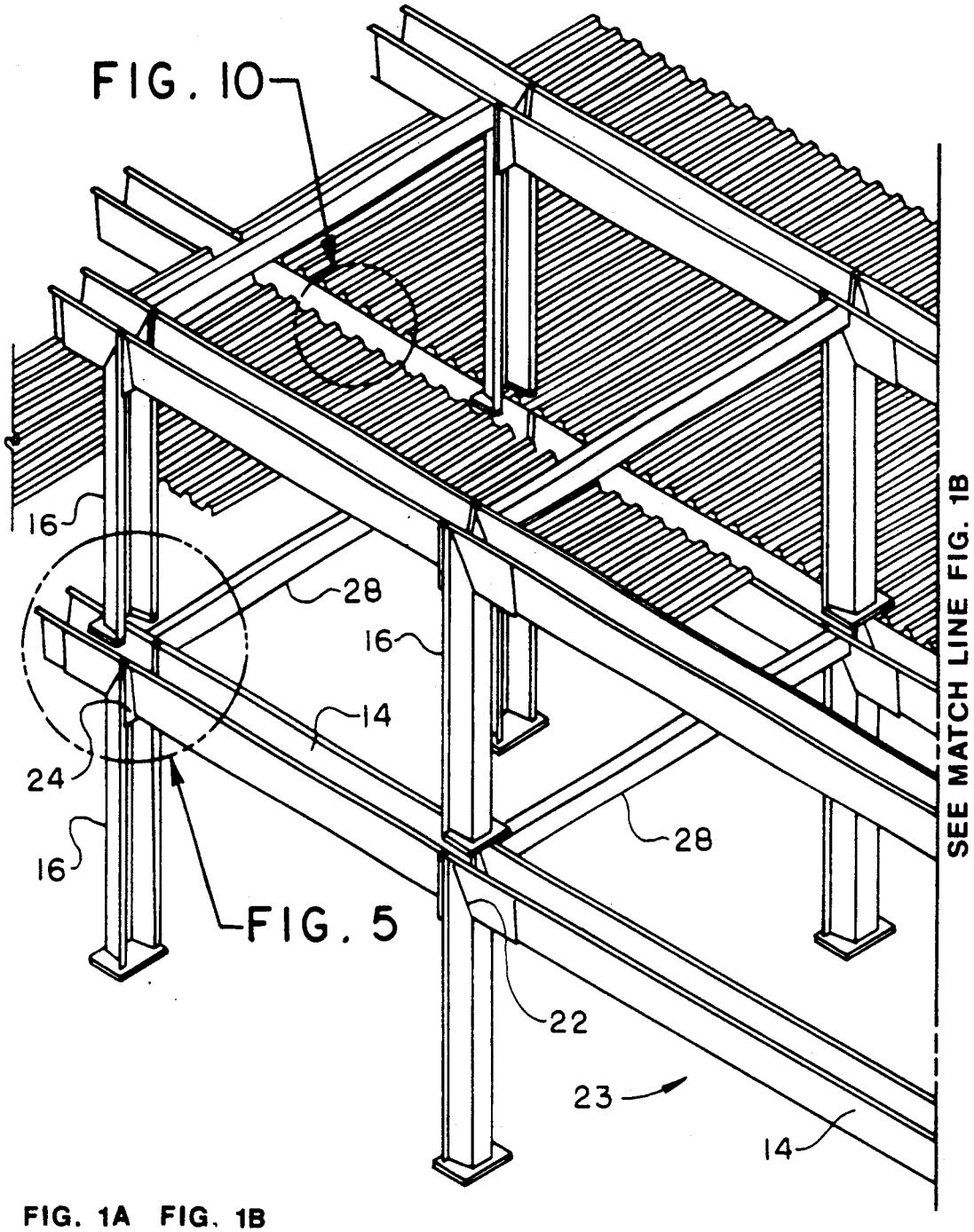
Figure 1A:
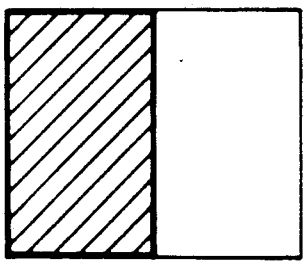

FIGS. 1A and 1B are isometric partial views of a structural frame for a building fabricated from the structural members of the invention. In the Figures, structural beam members 14 are shown connected to single column members 16 comprising vertical portions connected by weld joints 22 to column shoulders 18. The vertical portion of the columns making up the first story of the structure are positioned on base plates 20 with the column shoulders 18 serving as supports for structural beam members 14 and as supports for further columns positioned in axial alignment thereon. In the interior of the building, spacer beams 28 are positioned between columns 16 to provide uniform distance between the spans 23. The ends of adjacent spans are interconnected by means of structure end-beam members 26, while floor panels 30 extend between the spans, supported on the edges of the beam members. Details of the structural member junctures circled by the dotted lines are to be seen in the Figures to which reference is had.

As previously indicated, the structure shown is well suited for use in structures at least up to about five stories in height, including particularly schools, hospitals, and the like. The individual structural members, including the beam members 14 and column members 16, may be nested together, loaded into trucks, and transported to the building site, the trucks' loads being dictated by the weight of the nested structural members, rather than by volume as in the case of ordinary I-beams and similar structural components. Once at the site, the structural profiles are simply bolted together to form the desired building frame.

When the frame has been completed, and the floor panels bolted into place, concrete is poured into the structural members, which act as concrete forms, and onto the deck panels, as will be described in greater detail in the following. With the exception of the spacer beam members 28, which are not filled with concrete, the structural members have open tops, which facilitate the insertion of reinforcing bars in cases where additional strength is required.

Figure 2:
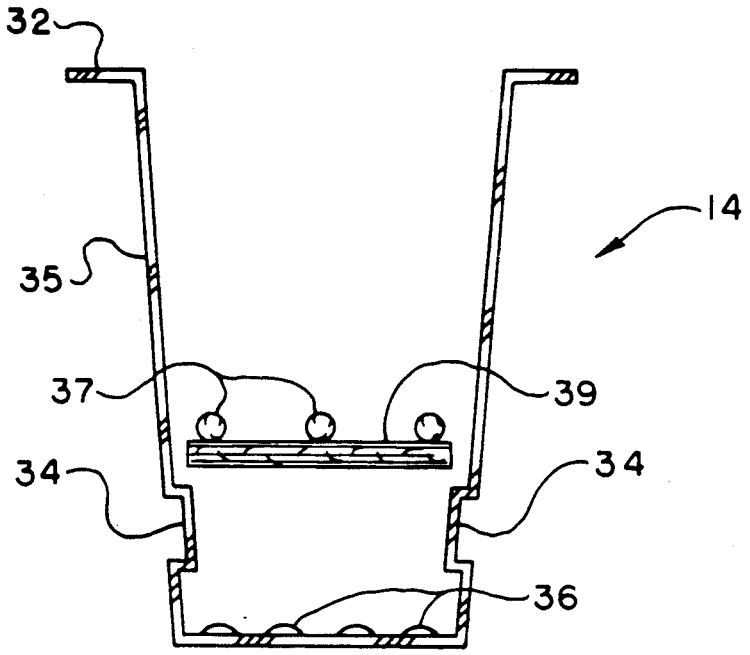
FIG. 2 is an end view of structural beam member of the invention.

FIG. 2 is an end view of structural beam member of the invention showing the truncated, V-shaped cross-section of the structural members. As shown in the Figure, the beam member 14 includes beam wings 32 extending outward from the top of the beam which among other functions, support deck panels positioned thereon. The beam wings are parallel to the bottom 36 of the beam. In any given structure, the width of the bottom of the structural members, and the width of the open top will be the same, although the length of the sides 35 of the beam may vary, for example, as between structural members making up the column shoulders 18 and the vertical portions of the columns 17, as better seen in FIG. 2A.

Also shown in the Figure are rib indents 34, and boss or dimple indents 36 that extend into the interior of the beam profiles, anchoring the concrete to the profiles. The dimple indents in the bottom of the profiles provide the important function of preventing movement of the concrete in the beam when the beam is subjected to loading and unloading. Although not as important as the dimple indents in the bottom, the rib indents further prevent the concrete's movement under similar conditions. Although other dimple shapes and sizes may be used, round dimples are commonly employed having a diameter of from about 1 to 1½ inches, and a height from about 1/16 to about 3/16 inch. Commonly, the dimples are positioned in transverse rows across the bottom of the member and spaced about 1 to 2 inches apart, measured from dimple-edge to dimple-edge, with the transverse rows being spaced about 1 to 3 inches apart. It will be understood, however, that different spacing, dimple sizes and shapes may also be employed without departing from the spirit of the invention.

While only one rib indent 34 is shown on each of the sides 35 of the structural member, more than that number can be used if desired. Although rib indents having different dimensions may be employed, typically, the rib indents will extend into the interior of the structural member from about ¾ inch to 1½ inch, and such indents will be from about 2 to 4 inches high.

Similarly, while beam members having different measurements may be employed, the wings of the beams will usually be from about 2½ inches to 3½ inches wide, and the bottom of the beam will be from about 7 inches to 9 inches wide, with the open top being from about 9 inches to 11 inches wide. The sides of the beams will normally range from about 11 inches to 17 inches high, based on their vertical dimension. As will be explained in the following, the structural members of the invention are advantageously made by the roll forming of steel sheet coils. When so fabricated, the width of the coil will normally determine the height of the sides, assuming the dimensions of the top and bottom of the structural member are maintained constant. In the case of a structural member with wings 3 inches wide, a bottom 8 inches wide and an open top 10 inches wide, for example, the vertical height of the sides will be about 16¾ inches when fabricated from a 48 inch coil; about 12¾ inches when made from a 40 inch coil; and approximately 8¾ inches when a 32 inch coil is used. While the beams can be made longer or shorter, ordinarily beams of from about 10 feet to about 32 feet long are convenient both from a structural and an erectional viewpoint.

The thickness of the metal from which the beams and columns are formed may be varied from about 1/16 to 3/16 inch, and will depend upon the structural requirements of the application contemplated.

With respect to the fabrication, a notable advantage of the structural members of the invention is that they can be fabricated by roll formers rather than by stamping processes. In fact, since it is important that the surfaces of adjacent members, for example, beam members resting in column shoulders, be characterized by a close fit, the roll forming procedure is of significant advantage since it allows more precise dimensions to be achieved. In forming the dimples 36, it will often be found desirable to use an eccentric press, for instance, of the 100 ton variety, provided with an appropriate die and a continuous feeder mechanism.

In some instances, particularly where greater strength is required, it has been found desirable to position reinforcing bars 37 in the structural profile members. This may be done by positioning the reinforcing bars on transverse supporting members 39 placed on the interior of the structural members. The fact that the structural members have an "open" top allows the positioning of the bars within the members to be readily accomplished. Thus, the steel/concrete composite structural members of the invention can be strengthened further if need be without increasing the thickness, and therefore the weight, of the profiles, a notable advantage of the invention. While only one tier of reinforcing bars is shown in the Figure, additional tiers may be employed if desired. Although such reinforcement is normally positioned in the lower ⅓ of the structural member, it may be positioned elsewhere if desired. A further advantage of the structural profiles contemplated by the invention is that they have open tops, facilitating placement of the reinforcement bars described.

Figure 2A:
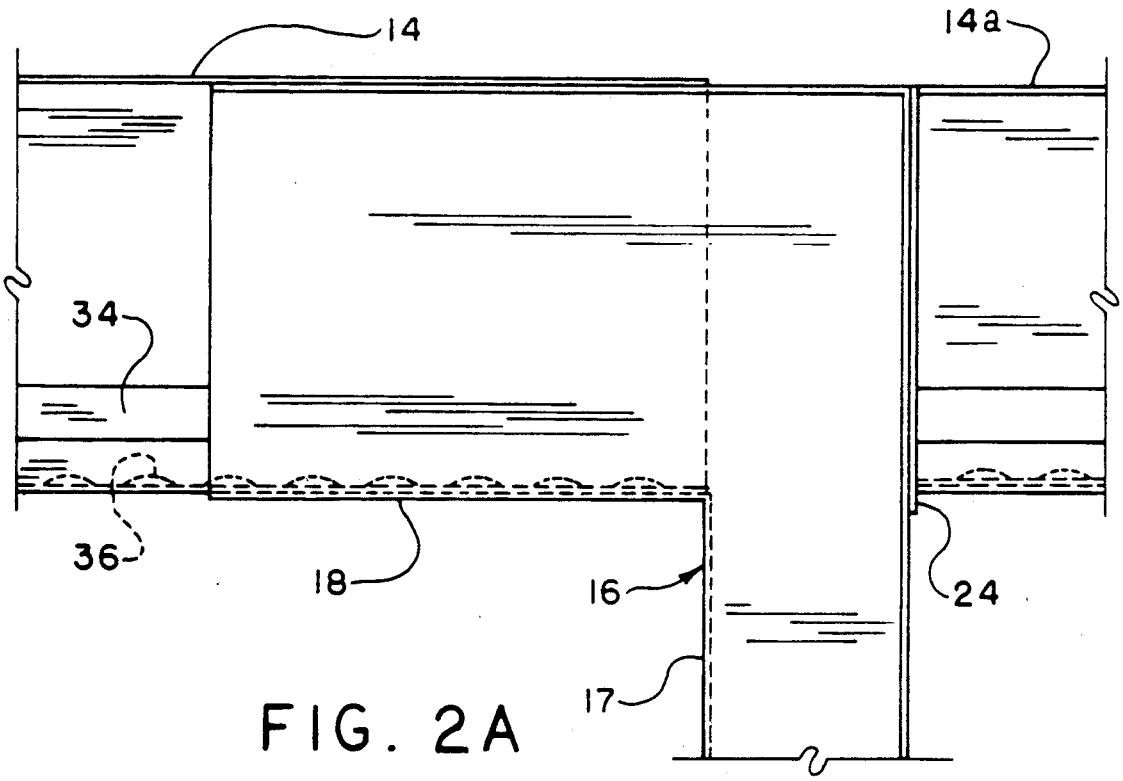
FIG. 2A is a partial front elevation of a structural member juncture showing the interconnection of structural beam members with a structural column member.

FIG. 2A is a partial front elevation of a structural member juncture showing the interconnection of structural beam members with a structural column member. As shown, a vertical portion 17 of the column 16, having a shape similar to the transverse cross-section shown in FIG. 2, connected by welding to the horizontal column shoulder 18 by means better illustrated in others of the Figures. A structural beam member 14 is shown being supported by the shoulder 18 while a another structural beam **14*a* is attached to the vertical portion of the column by means of a beam flange 24 connected to the column by bolts, not shown. Indenting of the beams including both rib indents 34, and dimple indents 36** is illustrated.

The height of the vertical portion of the column 17 may be varied, but normally, will be from about 8 feet to 15 feet high, 11 feet being typical, and the column will have a shoulder length of from about 16 inches to 20 inches. Although not normally included, indenting of the column may be employed if desired.

Figure 3:
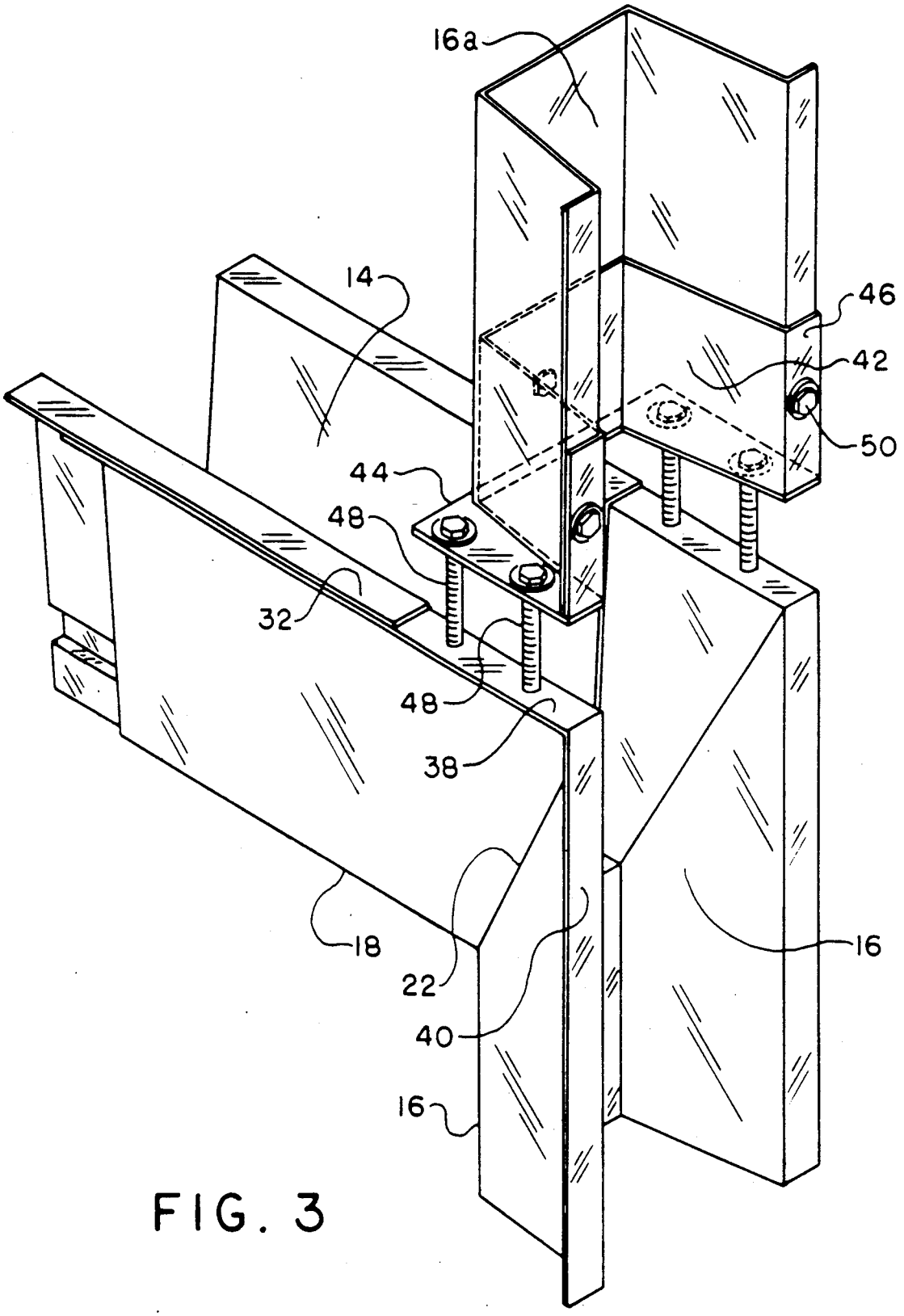
FIG. 3 is an isometric view of a structural member juncture showing the interconnection of a structural beam member with vertically aligned structural column members.

FIG. 3 is an isometric view of a structural member juncture showing the interconnection of a structural beam member with vertically aligned structural column members. In the Figure, as in others of the Figures included herewith, indentation of the respective members has not been illustrated in the interest of simplification. As shown, two columns, 16 and **16*a* respectively, are held in axial alignment by means of spacer bolts 48, better seen in FIG. 4. The spacer bolts engage shoe flange 46 by means of its associated flange 44 about which the upper column 16*a* is positioned, being held by fastener bolts 50. A structural beam 14 rests in, and is supported by the column shoulder 18 connected by weld joint 22 to the vertical portion of the column 16. The spacer bolts 48 serve both to align the superimposed column 16*a***, as well as to fasten the columns together in a way that provides a gap between the columns of sufficient height to accommodate a concrete floor extending therebetween.

Figure 4:
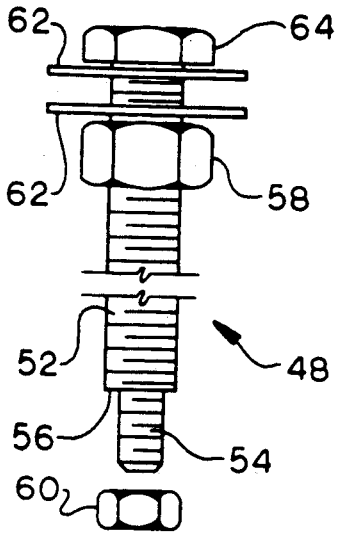
FIG. 4 shows a front elevation of a spacer bolt, including its associated nuts and washers.

FIG. 4 shows a front elevation of a spacer bolt, including its associated nuts and washers. The Figure illustrates how the flange 44 of shoe 46, illustrated for example in FIG. 3, is held between washers 62 positioned below bolt head 64, and above larger nut 58, respectively. Between the larger diameter shank 52 of spacer bolt 48 and its smaller diameter shank 54 is a shoulder 56 which rests upon the shoulder wings of a column shoulder 18 when the spacer bolt is inserted through a hole in the wings. Smaller nut 60, threadably engaging smaller diameter shank 54 completes the assembly and bolts the two columns securely together.

By suitably fabricating the length of the larger diameter shank 52, the clearance between the aligned columns may be varied to accommodate whatever floor height is desired. Commonly, however, the height of the shank will be selected to accommodate a floor of from about 4 to 5 inches high.

Figure 5:
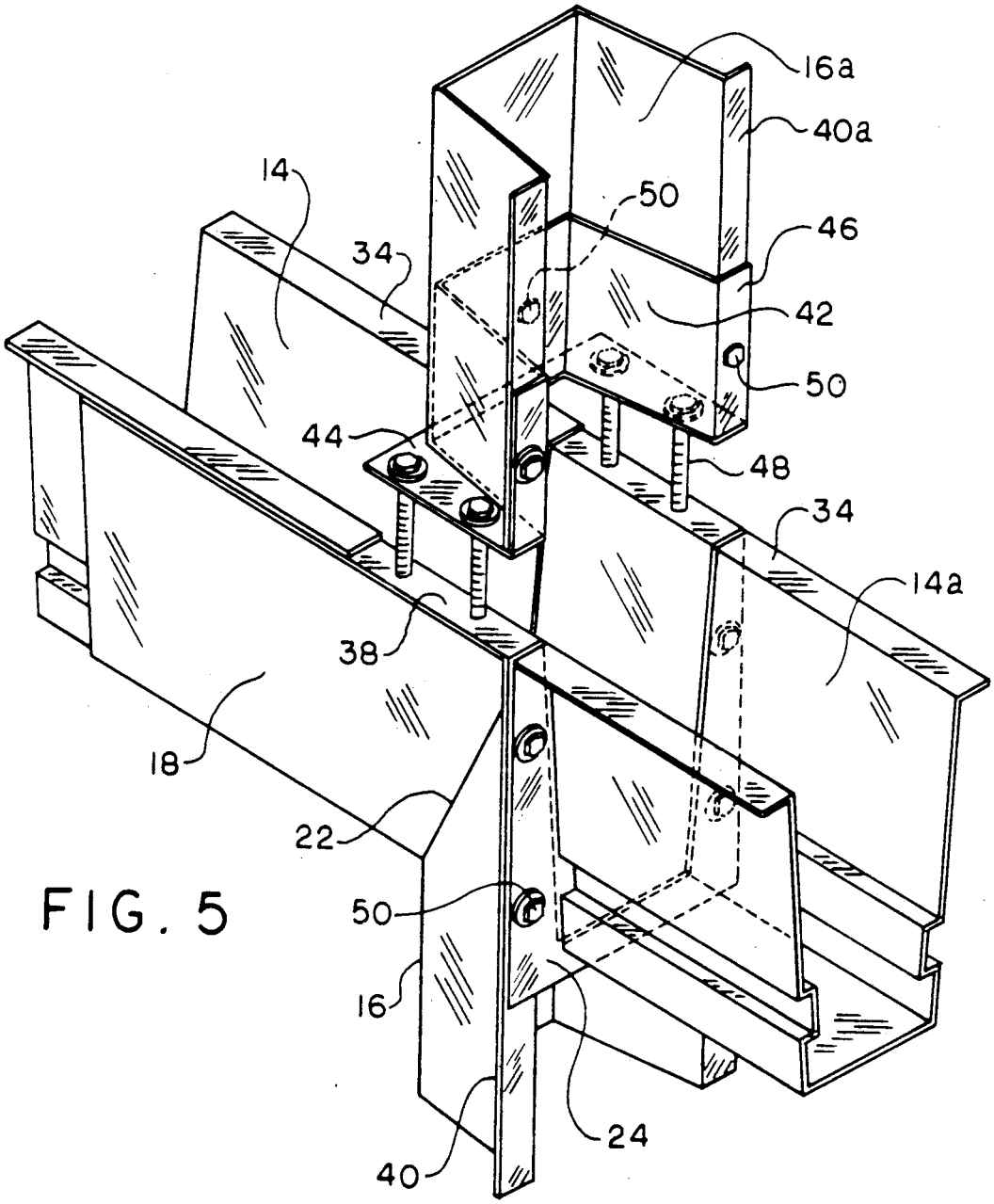
FIG. 5 is an isometric view of a structural member junction showing the interconnection of two structural beam members with vertically aligned structural column members.

FIG. 5 is an isometric view of a structural member juncture showing the interconnection of two structural beam members with vertically aligned structural column members. In this Figure, column 16 is connected to column 16*a* be means of spacer bolts 48 connecting the shoulder wings 38 of column shoulder 18 to the flange 44 of a single column shoe 46 about which column 16*a* is positioned. Again fastener bolts 50 attach the shoe to the column wings 40*a*. The vertical portion of the column 16 is connected to the column shoulder 18 by means of a weld joint 22, the shoulder acting as a support for the structural beam 14 enclosed therein and connected thereto by fastener bolts, not shown. Another structural beam member 14*a* is connected to the column wings 40 of the vertical portion of column 16 by means of fastener bolts 50 extending through a beam flange 24 connected to the beam 14*a*. The Figure illustrates the case in which a single column is employed for the structural member juncture, in contrast to a double column, as better seen in FIG. 9. In the case of the single column, one of the supported beams lies within the shoulder of the column, the other being bolted to the wings of the column's vertical portion. In the case of the double column, both beams lie in adjacent column shoulders.

Figure 6:
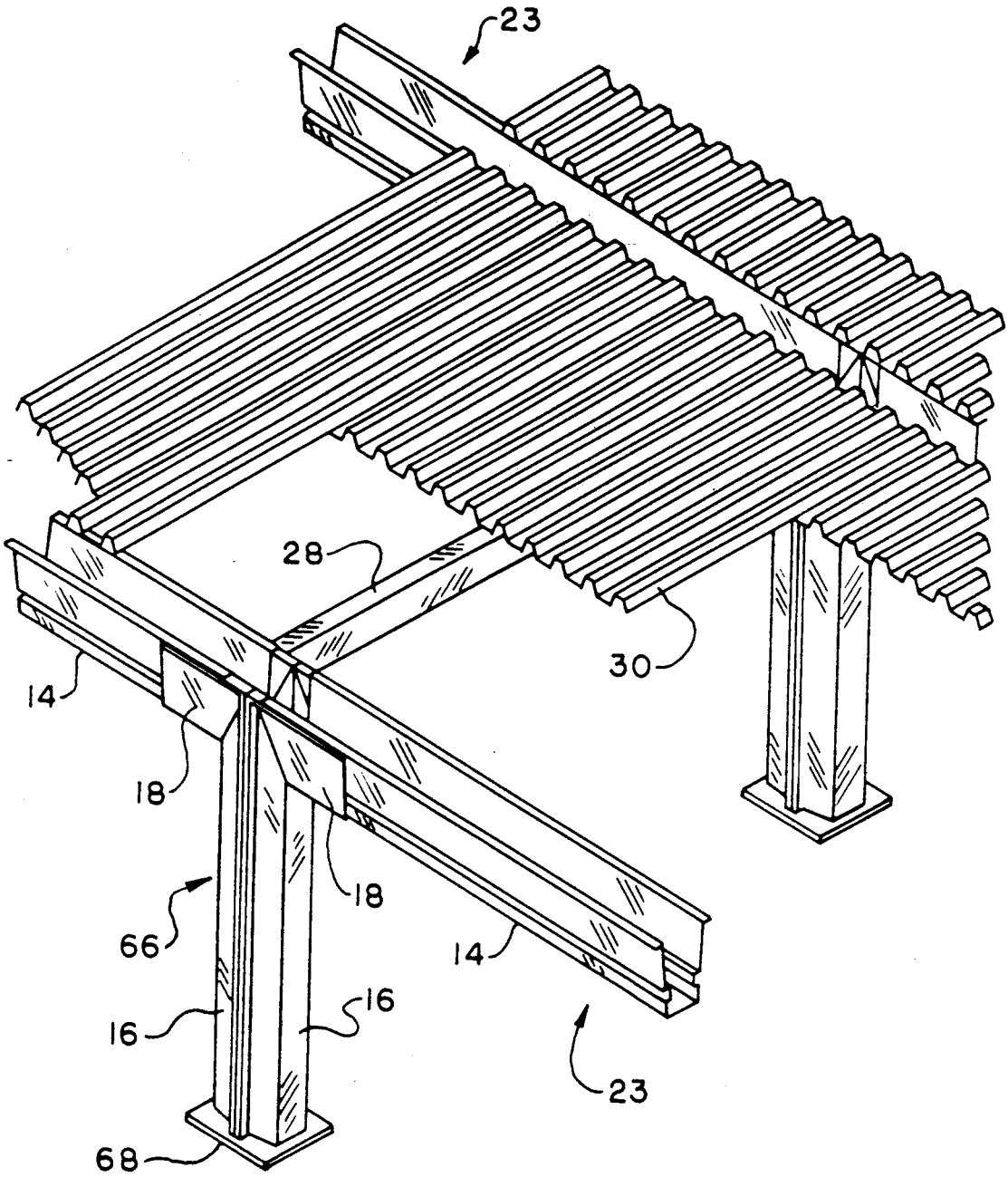
FIG. 6 is an isometric partial view of a structural frame for a building illustrating the use of double structural column members.

FIG. 6 is an isometric partial view of a structural frame for a building illustrating the use of double structural column members. Shown in the Figure is a one story structure employing two single columns 16, held in such position, back-to-back, by fastener bolts, not shown, to form a double column 66. The double column rests on a double column base plate 68 and supports two structural beams 14 in the column shoulders 18. Two adjacent spans 23 are shown spaced apart by means of spacer beam members 28. Supported on the beams of the adjacent spans is floor paneling 30. The spacer beams 28 not only assist in correct spacing of the spans during the erection process, but helps to maintain that spacing and rigidify the structure even after its completion.

In the process of erection, the columns are set in place and the structural beams are positioned so to be supported by the columns, either by flanges or by column shoulders, as the case may be, and bolted together. Following such placement and interconnection, the concrete is poured in the beams and columns, and over floor panels fastened to the beam members, as will be described in more detail in the following. If desired, reinforcing bars may be positioned in the columns, as well as in the beams, to provide extra strength. After the concrete has set, and if desired, subsequent floors can be constructed by axially aligning columns on top of the first floor columns, supporting new beams therein, attaching floor paneling and proceeding generally as in the case of the first floor. Subsequent floors may be added in like fashion.

Figure 7:
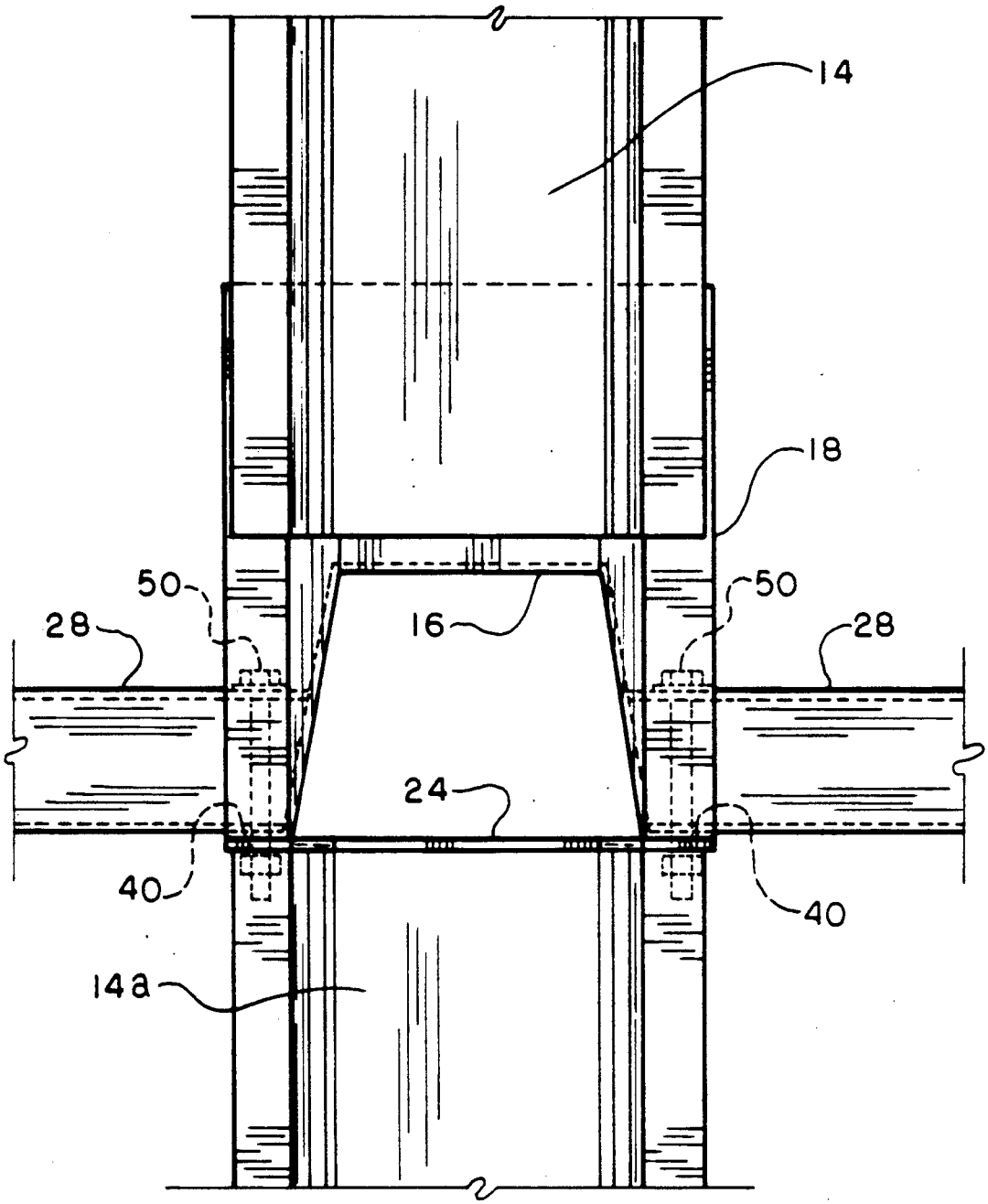
FIG. 7 is a top view of a structural member juncture showing the interconnection of a structural column member with structural beam members and spacer beam members.

FIG. 7 is a top view of a structural column member with structural beam members and spacer beam members. The Figure illustrates a single column 16, including an attached column shoulder 18 with spacer beams 28 connected thereto by fastener bolts 50 passing through the column wings 40. On one side of the column a structural beam 14 is supported in column shoulder 18, while another structural beam 14*a* is connected to the column 16 by a beam flange 24. As previously related, although not filled with concrete, the spacer beams 28 provide spacing and additional rigidity to the spans both during and after their erection.

Figure 8:
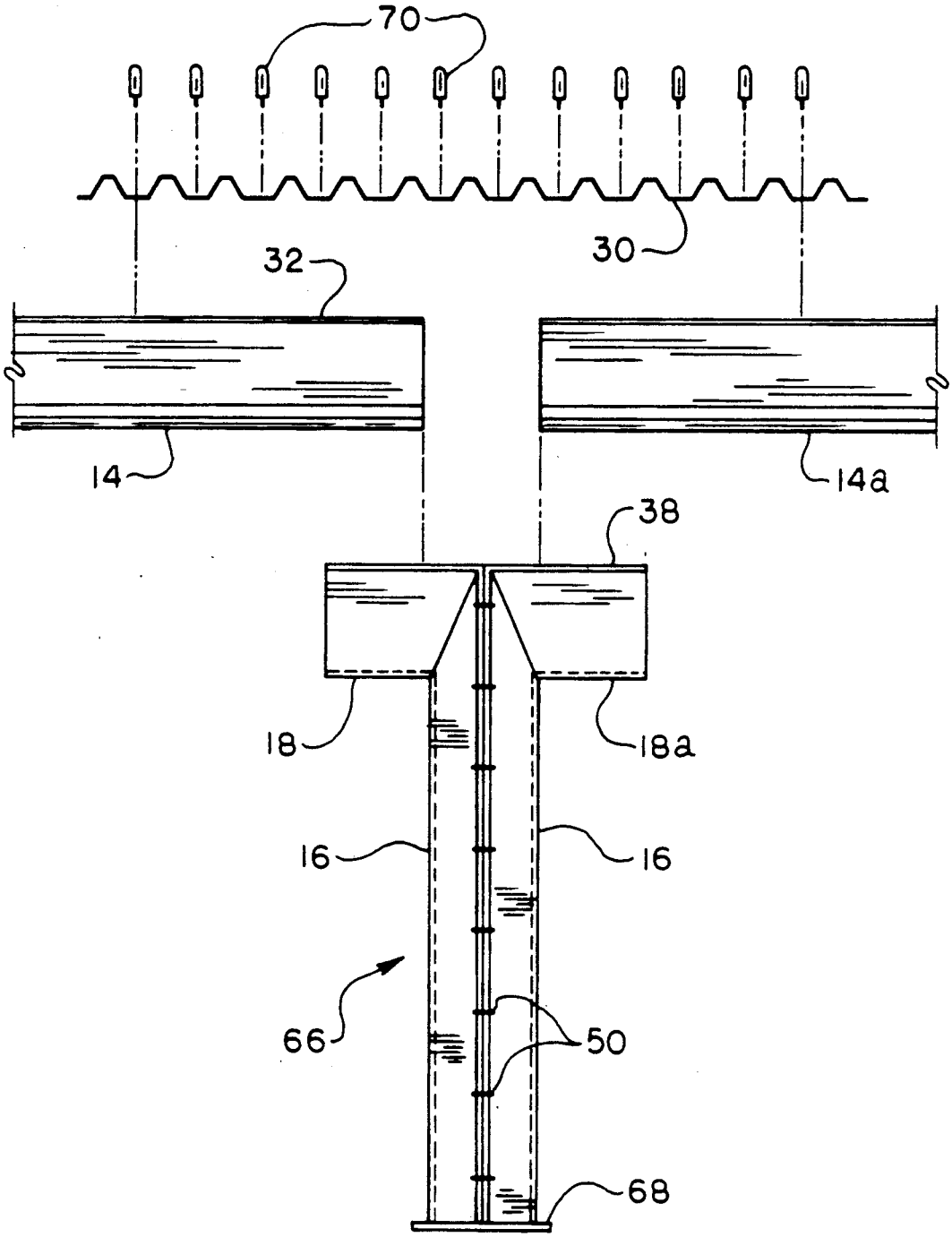
FIG. 8 is an exploded front elevation view of a double structural column member with its associated structural beam members, floor panels, and shoulder U-bolts.

FIG. 8 is an exploded front elevation view of a double structural column member with its associated structural beam members, floor panels, and connecting shouldered U-bolts.

The Figure illustrates the use of a double column 66 comprising two single columns 16 held in a back-to-back position by means of fastener bolts 50. The construction is used where two long spans are to be erected adjacent to each other with no short span in between, although the double columns can be used elsewhere as well. As shown, two structural beams 14 and 14*a* are placed in the column shoulders 18 and 18*a*, respectively. Finally, a floor panel 30 is positioned on the shoulder wings 38 of the columns and fastened thereto by means of shouldered U-bolts 70, better seen in connection with FIG. 10. The floor panel 30 not only serves as a base and as a form for the concrete flooring, not shown, but provides reinforcing both to the floor and to the structure itself. If desired, reinforcing bar may be positioned in the concrete on top of the floor panel.

Figure 9:
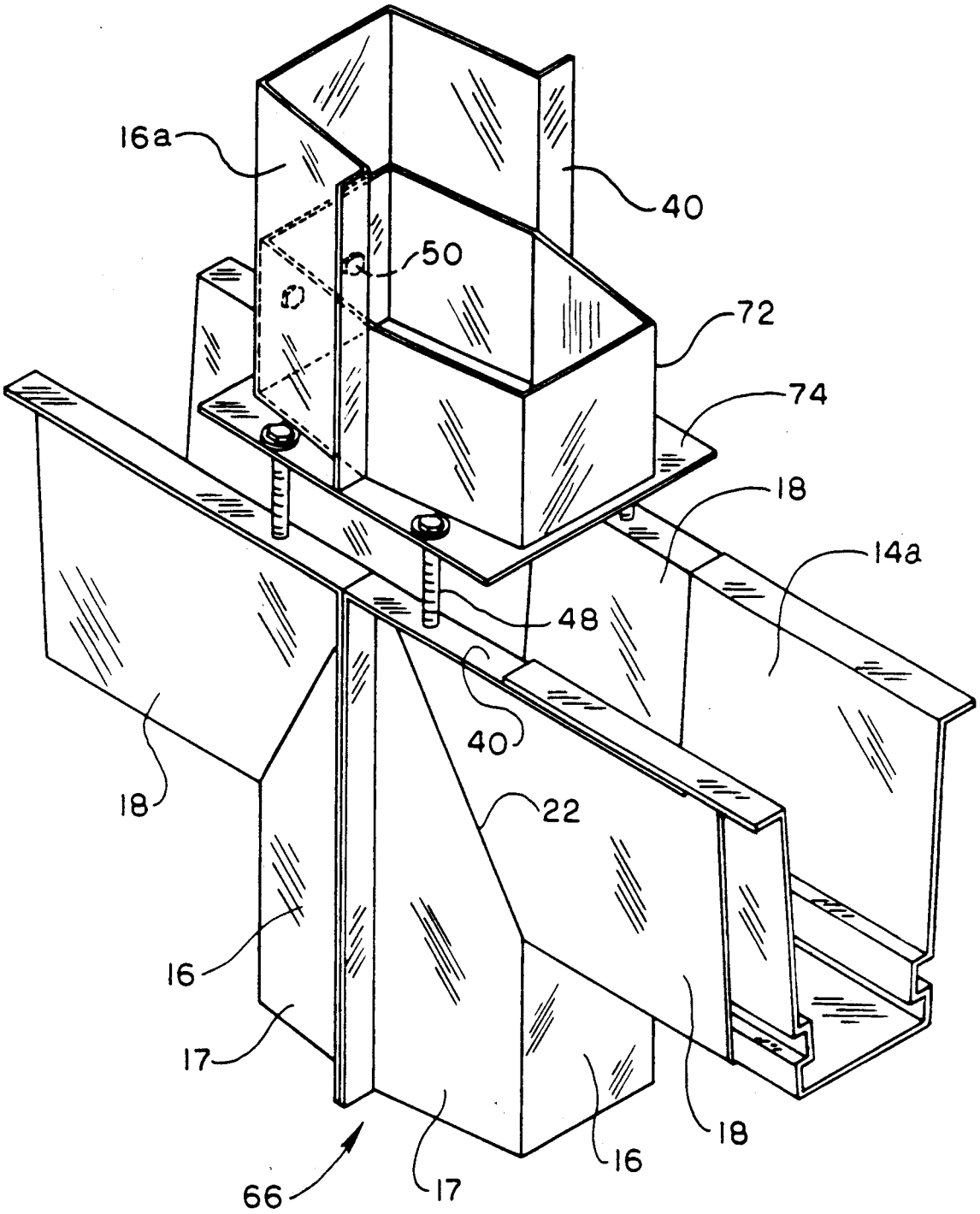
FIG. 9 is an isometric view of a structural member juncture showing the interconnection of vertically aligned double structural column members with two structural beam members.

FIG. 9 is an isometric view of a structural member juncture showing the interconnection of vertically aligned double structural column members with two structural beam members. Again, the double columns 66 are formed from two single columns 16, the vertical portion 17 of each of which is connected by weld joints 22 to column shoulders 18. In axial alignment and superimposed over the lower double column is a double column shoe 72 attached to the column wings 40 of the lower double column by means of spacer bolts 48 extending from holes in the wings to holes in the double column shoe flange 74. Only one of the single column members 16*a* making up the upper double column is shown, fastened to the double column shoe 72 by means of fasteners 50. A structural beam 14*a* is also illustrated positioned in, and supported by one of the column shoulders 18.

Shoe 74 serves both to align the superimposed double columns with each other, as well as to reinforce the anchor point of the upper column. As previously indicated, where double columns are used, the structural beams forming part of the structural member juncture are supported by being placed in the column shoulders and secured there by fasteners, better seen in FIG. 10, rather than by a connection involving a beam flange 24, as illustrated in FIG. 5.

Figure 10:
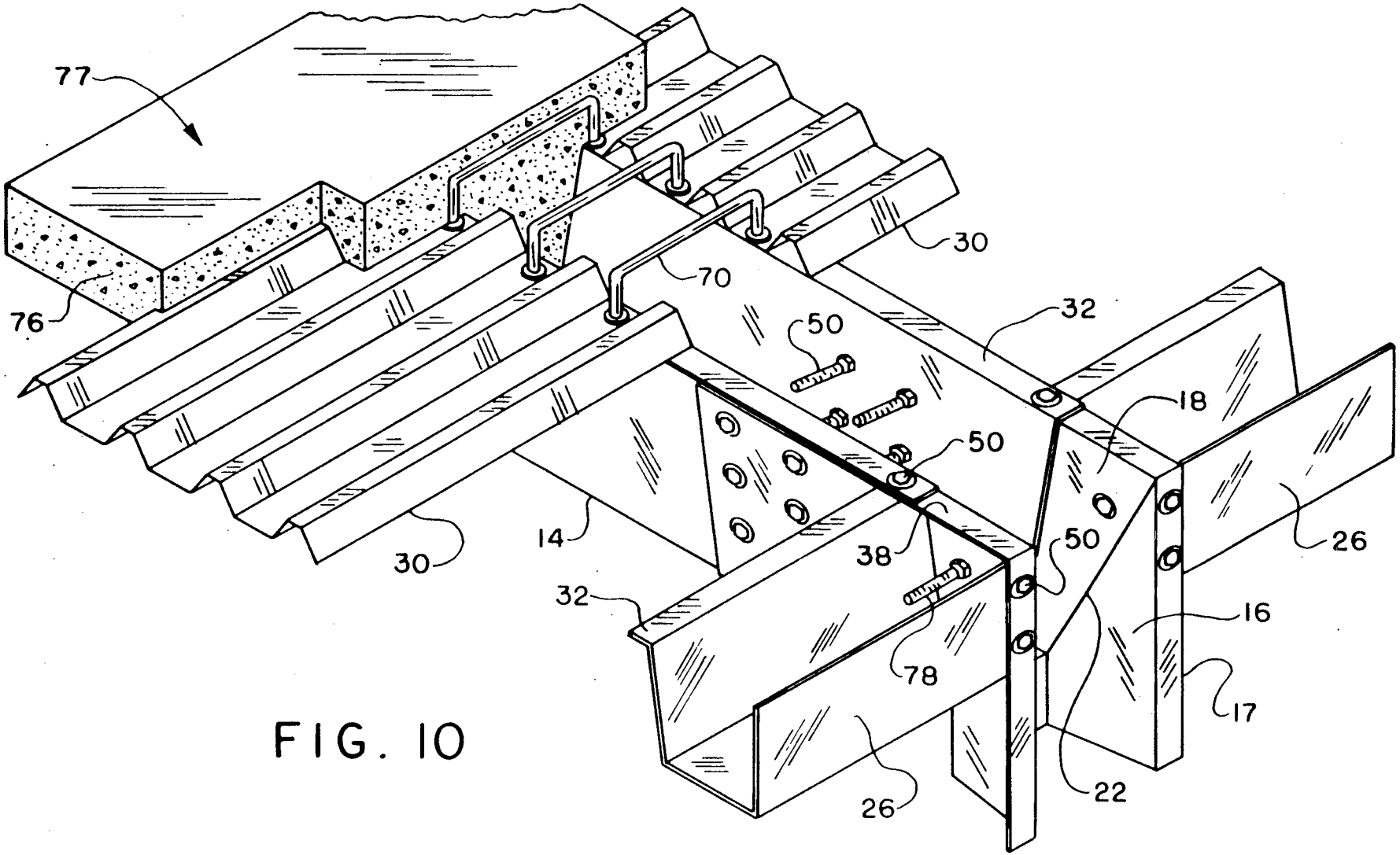
FIG. 10 is an isometric view of a structural member showing the interconnection of a structural beam member, structural end beam members, and a structural column member, the structural beam member being shown with associated floor panels and shouldered U-bolts.

FIG. 10 is an isometric view of a structural member showing the interconnection of a structural beam member, structural end beam members, and a structural column member, the structural beam member being shown with associated floor panels and shouldered U-bolts. The U-bolts serve the important function of assuring that the beam members and floor panels attached thereto "work" together in an integrated relationship. In FIG. 10, a column 16 including a vertical portion 17 and a column shoulder 18, and fastened together by weld joint 22 are shown with structural end beams 26 attached to the wings of the column by means of fasteners 50. A structural beam 14 is supported in column shoulder 18 and bolted thereto by fastener bolts 50. Attached to the beam wings 32 by means of shouldered U-bolts 70 are floor panels 30. The concrete 77 for filling structural beam 14 and forming the flooring is also illustrated. While the structural end beams 26 are not portrayed with concrete therein, anchor bolt 78 designed to help anchor concrete placed therein is illustrated.

It will be observed that the end beams 26 of the Figure have a beam wing 32 only on one side thereof. This permits the opposite side of the structural end beam to form a flush surface with the open side of the vertical portion 17 of column 16, permitting the outside facade of the building to lie substantially in a single plane. Such construction permits the outside of the building to be finished in a pleasing fashion with no discordant protrusions extending therefrom.

While end beams 26 are shown without indents extending into the interior thereof to stabilize the concrete included therein, they may be so furnished if desired.

The number of fasteners 50 connecting the column shoulder 18 and structural beam 14 together will be determined by engineering stress calculations, based upon the anticipated stress on the juncture. The fasteners are shown extending substantially into the interior of the structural beam, an expedient that allows them to serve as concrete anchors, as well as fasteners.

While the horizontal portions of the structural member profiles contemplated by the invention may be filled with concrete, which is held therein by gravity during the setting process, in order to fill the vertical portions 17 of the column 16, temporary plywood facing may be fastened over the open portion thereof by means of clips snapped over the plywood and wings of the column, thereby allowing concrete to be poured and retained within the column. After the concrete has set, the clips and plywood facing may be removed.

Figure 11:
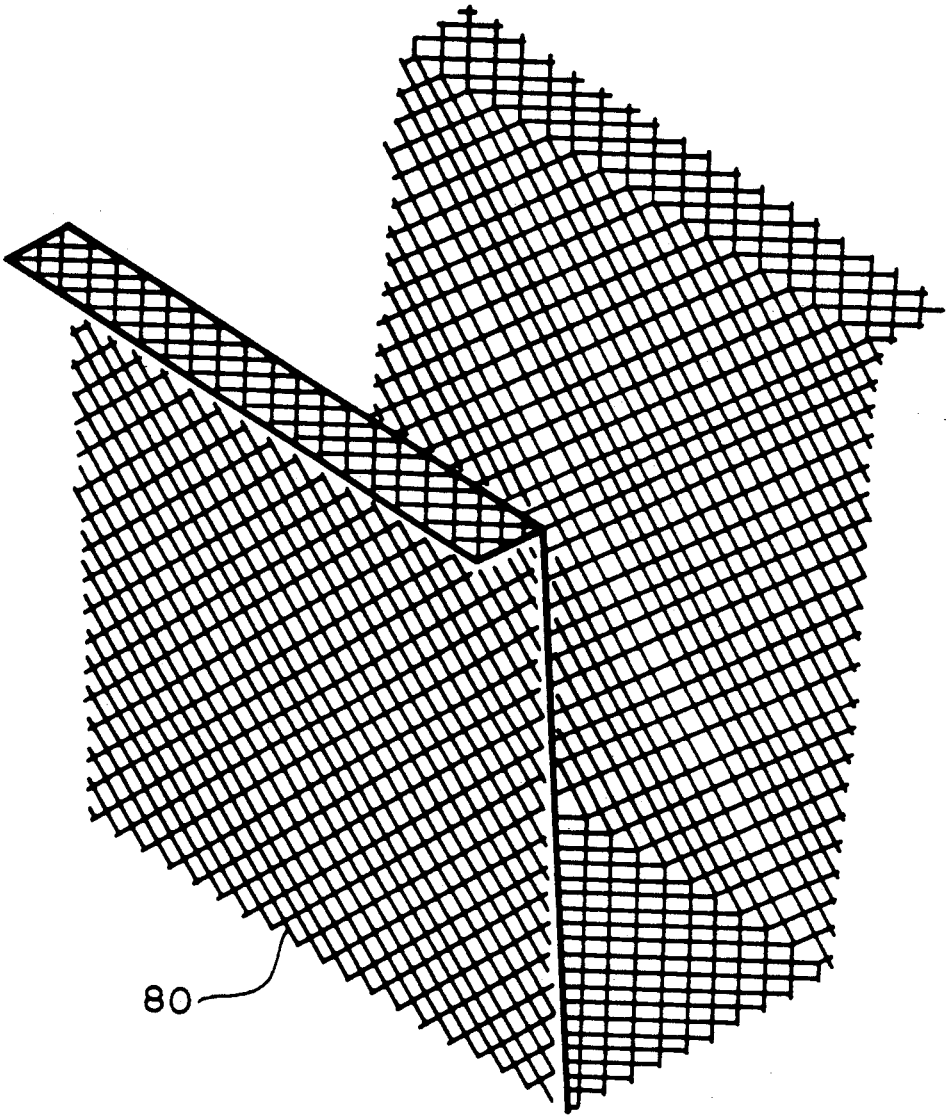
FIG. 11 is an isometric view of a lath screen jacket for a structural beam member of the invention.

FIG. 11 is an isometric view of a lath screen jacket for a structural beam member of the invention. The lath screen 80, which is attached as better seen in connection with FIG. 12, allows structural members to be fireproofed by serving to hold concrete sprayed or otherwise applied thereon. It also facilitates covering the outside of the structural members with decorative plaster or other mastics where that is desirable.

Figure 12:
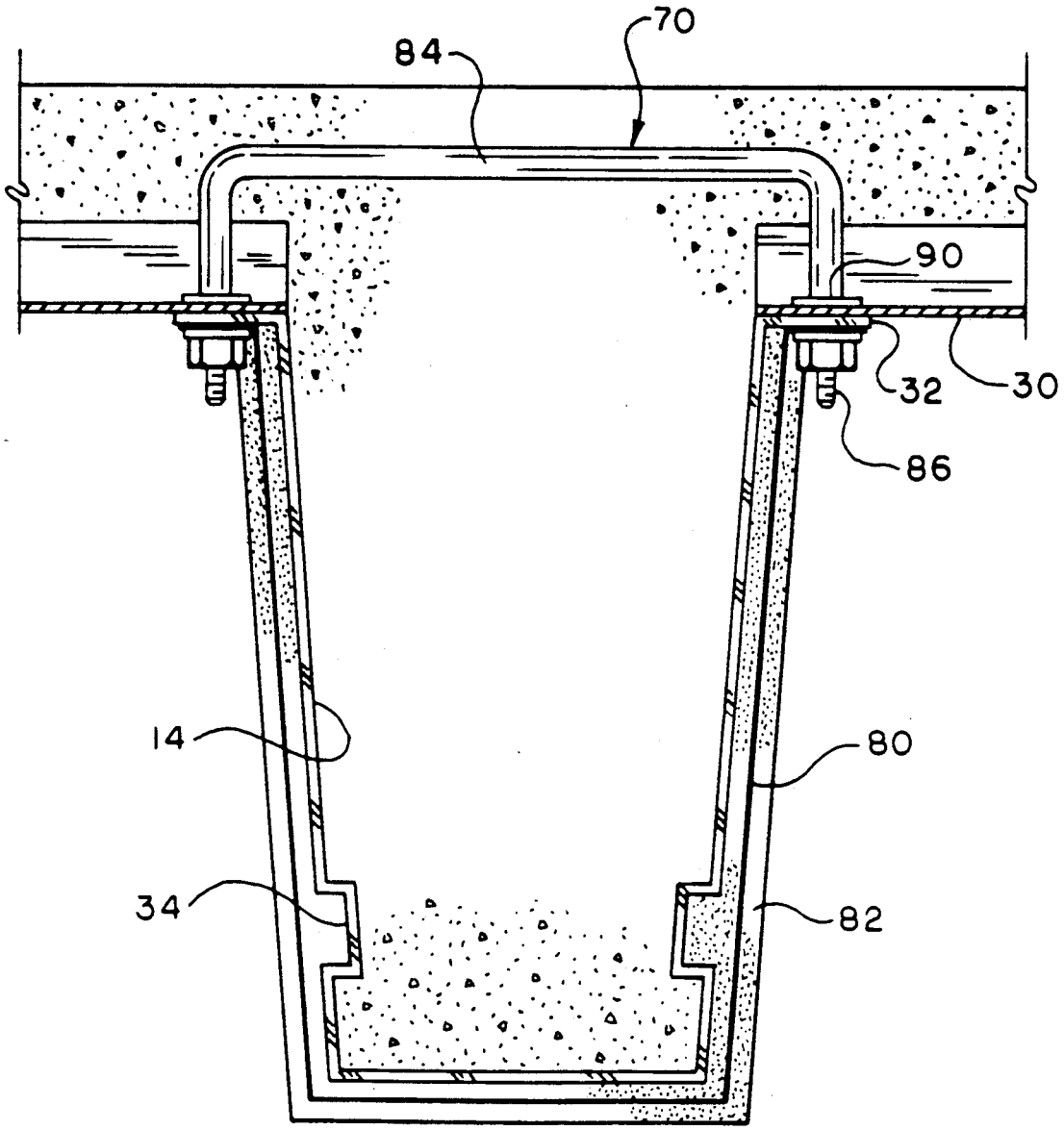
FIG. 12 is an end view of a clad structural beam member fastened to deck panels with shouldered U-bolts.

FIG. 12 is an end view of a clad structural beam member fastened to deck panels with shouldered U-bolts. As shown, lath screening 80 is fastened to the outside of a structural beam 40 by means of a shouldered U-bolt 70. Applied to the outside of the lath screening 80 is a layer of lath coating 82 which may be concrete, plaster, or other desired mastic material.

The U-bolts are similar in operation to the spacer bolts 48 in that they include a larger diameter shank 84, and a smaller diameter shank 86, with a shoulder 90 formed at the juncture of the two. This enables the smaller diameter portion of the bolt 86 to extend through the floor panel 30 and beam wing 32 while the larger diameter shank 84 is retained above the floor paneling by virtue of the shoulder 90. Thus the insertion of the bolt as described automatically positions the height of the bolt, permitting it to serve as a stabilizing anchor for concrete poured around it, as well as a means for fastening the floor panel and structural beam together.

While in accordance with the patent statutes, a preferred embodiment and best mode has been presented, the scope of the invention is not limited thereto, but rather is measured by the scope of the attached claims.

What is claimed is:

1. An elongated, hollow steel structural member useful for fabricating structures therefrom comprising a trough-like profile that includes:

a closed bottom;
an open top;
two sides; and
horizontal flat wing-like flanges, said sides diverging as they extend upward from said bottom to said top; said flanges extending outward from said top, parallel to said bottom, and said bottom having dimpled boss indentations extending into the interior of said profile in which at least one end of said member has a connection flange attached at right angles to the outside perimeter of said end.

2. Skeletal framing for a building structure formed from interlocked structural components comprising vertical column members and horizontal beam members, said components being formed from elongated profiles that include:

a closed bottom;
an open top;
two sides; and
wing-like flanges, said sides diverging as they extend upward from said bottom to said top and said side flanges extending outward from the top of at least one of said sides, parallel to said bottom, said profiles being provided with indentations that extend into the interior of said profiles said profiles being filled with concrete, and said beam members supporting deck panels connected to said flanges of said profiles, wherein said deck panels are connected to said flanges with U-bolts having threaded ends, the diameter of said threaded ends being smaller than at least a portion of the rest of said bolts.

3. Skeletal framing for a multi-story structure wherein column members, in which counterpart surfaces of two trough-like profiles that include:

a closed bottom;
an open top;
two sides; and
wing-like flanges, are joined to each other at right angles to form said structural column members having a vertical section and a horizontal section, and in which said two profiles have open tops of equal width and closed bottoms of equal width, said sides diverging as they extend upward from said bottom to said top with said flanges extending outward from said top, parallel to said bottom, and said bottom having indentations extending into the interior of said profile, are positioned over the tops of others of said column members, in vertical axial alignment therewith, each of said upper column members resting on column support means spaced from the top of the column member beneath it by spacer bolts, said spacer bolts comprising:

a bolt head;
an upper, larger diameter threaded portion with a first nut engaged therewith;
a lower, smaller diameter threaded portion with a second nut engaged therewith; and
a shoulder between said larger diameter portion and said smaller diameter portion, wherein said support means is secured between said head and said first nut, and the column beneath is secured between said shoulder and said second nut, the distance between said shoulder and said first nut providing said spacing.

4. Skeletal framing according to claim 3 wherein said support means comprises a support member having substantially the same transverse cross-sectional shape as the vertical portion of said column members, said support member having a horizontal support flange attached at right angles to the outside perimeter of the lower end of said support member.

5. A component for a structure wherein the vertical portions of two structural column members comprising trough-like profiles that include:

a closed bottom;

an open top;

two sides; and wing-like flanges, in which said sides diverge as they extend upward from said bottom to said top and said flanges extend outward from said top, parallel to said bottom, with said bottom having indentations extending into the interior of said profile, and in which counterpart surfaces of two of the profiles are joined to each other at right angles to form said structural columns having a vertical section and a horizontal section, said two profiles having open tops of equal width and closed bottoms of equal width, are positioned back-to-back with surfaces of their vertical wing-like flanges adjacent to each other and connected together.

* * * * *